US011603845B2

(12) United States Patent
Huang

(10) Patent No.: US 11,603,845 B2
(45) Date of Patent: Mar. 14, 2023

(54) MAGNETIC DRIVE PUMP

(71) Applicant: ZI YI ELECTRICAL ENGINEERING CO., LTD., Taichung (TW)

(72) Inventor: Ting-Tsai Huang, Taichung (TW)

(73) Assignee: ZI YI ELECTRICAL ENGINEERING CO., LTD., Taichung (TW)

( * ) Notice: Subject to any disclaimer, the term of this patent is extended or adjusted under 35 U.S.C. 154(b) by 115 days.

(21) Appl. No.: 17/173,249

(22) Filed: Feb. 11, 2021

(65) Prior Publication Data

US 2022/0252069 A1 Aug. 11, 2022

(51) Int. Cl.

| | |
|---|---|
| ***F04D 13/02*** | (2006.01) |
| ***F04D 29/40*** | (2006.01) |
| ***F04D 29/18*** | (2006.01) |
| ***F04D 13/06*** | (2006.01) |

(52) U.S. Cl.

CPC ..... *F04D 13/02* (2013.01); *F04D 13/0626* (2013.01); *F04D 29/18* (2013.01); *F04D 29/406* (2013.01)

(58) Field of Classification Search

CPC ..... F04D 29/18; F04D 13/025; F04D 13/0626

See application file for complete search history.

(56) References Cited

U.S. PATENT DOCUMENTS

| | | | | |
|---|---|---|---|---|
| 4,838,763 | A * | 6/1989 | Kramer | F04D 13/0626 417/63 |
| 4,854,823 | A * | 8/1989 | Hatting | F04D 15/0263 417/63 |
| 5,336,996 | A * | 8/1994 | Rusnak | F04D 13/024 417/63 |
| 7,249,939 | B2 * | 7/2007 | Yanagihara | F04D 29/026 417/420 |
| 9,169,842 | B2 * | 10/2015 | Chien | H02K 5/18 |
| 9,617,999 | B2 * | 4/2017 | Schneider | H01F 7/0242 |

FOREIGN PATENT DOCUMENTS

| | | |
|---|---|---|
| TW | I424661 | 1/2014 |

* cited by examiner

*Primary Examiner* — Nathan C Zollinger
*Assistant Examiner* — Timothy P Solak
(74) *Attorney, Agent, or Firm* — Burris Law, PLLC

(57) ABSTRACT

A pump includes a seat unit, a motor unit and a leak detector. The motor unit includes a rotor, an inner case body, an outer case body and a stator. The inner case body has an inner end wall. The outer case body is sleeved on the inner case body and has an outer end wall. The outer end wall cooperates with the inner end wall to define a liquid-receiving space therebetween. The leak detector is disposed on one side of the outer end wall opposite to the liquid-receiving space and includes a sensor for detecting the change of the electrostatic capacity between the liquid-receiving space and the sensor.

5 Claims, 3 Drawing Sheets

MAGNETIC DRIVE PUMP

FIELD

The disclosure relates to a pump, and more particularly to a pump having a leak detector.

BACKGROUND

A conventional pump disclosed in Taiwanese Patent No. I424661 includes a front cover, a support frame, an impeller, a cup-shaped rear cover, an inner rotor, an outer rotor, a stationary shaft and a handling frame. The rear cover has a double-layered structure, and includes an inner lining made of a fluoroplastic material, and a reinforced layer.

The inner lining and the reinforced layer abut against one another to form the double-layered structure of the rear cover. As such, when the pump is used in a piece of chemical processing equipment, if the inner lining is damaged, chemical liquid may leak through the crack of the inner lining into the gap between the inner lining and the reinforced layer. However, the leakage through the inner lining cannot be detected by the conventional pump, which allows the chemical liquid to leak further into the outer rotor and corrode the outer rotor. As a result, the pump malfunctions.

SUMMARY

Therefore, an object of the disclosure is to provide a pump that can alleviate the drawback of the prior art.

According to the disclosure, the pump includes a seat unit, a motor unit and a leak detector. The seat unit includes a fixed seat, a surrounding seat and a seat base. The fixed seat surrounds an axis. The surrounding seat is sleeved on the fixed seat. The seat base is for the surrounding seat to be disposed on. The motor unit includes a rotor, an inner case body, an outer case body and a stator. The rotor is rotatable about the axis. The inner case body surrounds the rotor. The outer case body is sleeved on the inner case body. The stator surrounds the outer case body and is surrounded by the fixed seat about the axis. The inner case body has an inner surrounding wall and an inner end wall. The inner surrounding wall surrounds the rotor and has two inner opposite ends spaced apart from each other in the direction of the axis. The inner end wall is connected to one of the inner opposite ends. The inner surrounding wall and the inner end wall cooperatively define a disposing space that opens at the other one of the inner opposite ends and that is for the rotor to be disposed within. The outer case body has an outer surrounding wall and an outer end wall. The outer surrounding wall is sleeved on the inner surrounding wall, is surrounded by the stator and has two outer opposite ends that are spaced apart from each other in the direction of the axis. The outer end wall is connected to one of the outer opposite ends and is located at one side of the inner end wall opposite to the disposing space. The outer end wall cooperates with the inner end wall to define a liquid-receiving space therebetween. The leak detector is disposed on one side of the outer end wall that is opposite to the liquid-receiving space, and includes a sensor that is for detecting the change of the electrostatic capacity between the liquid-receiving space and the sensor.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
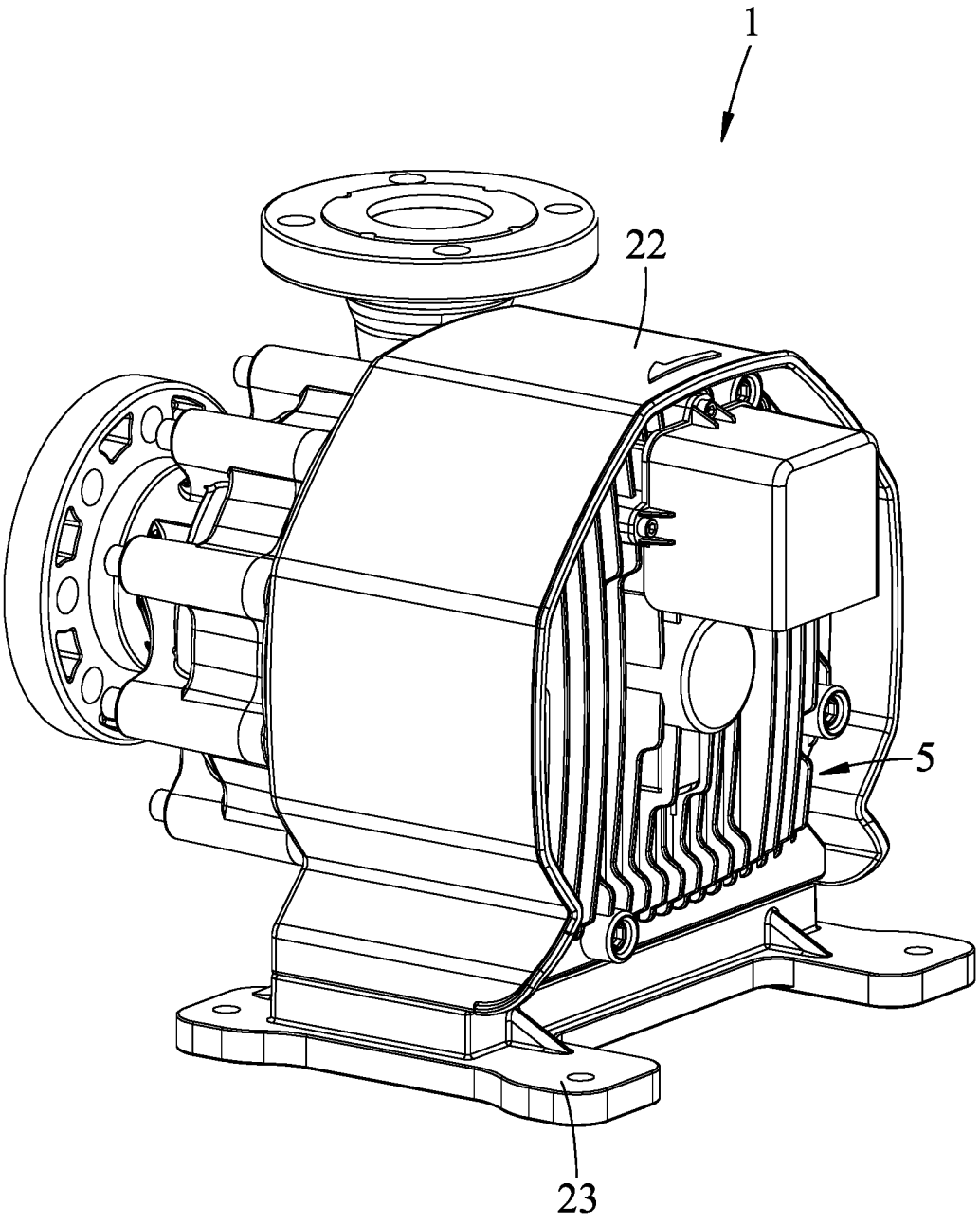
FIG. 1 is a perspective view illustrating an embodiment of a pump according to the disclosure.
Figure 2:
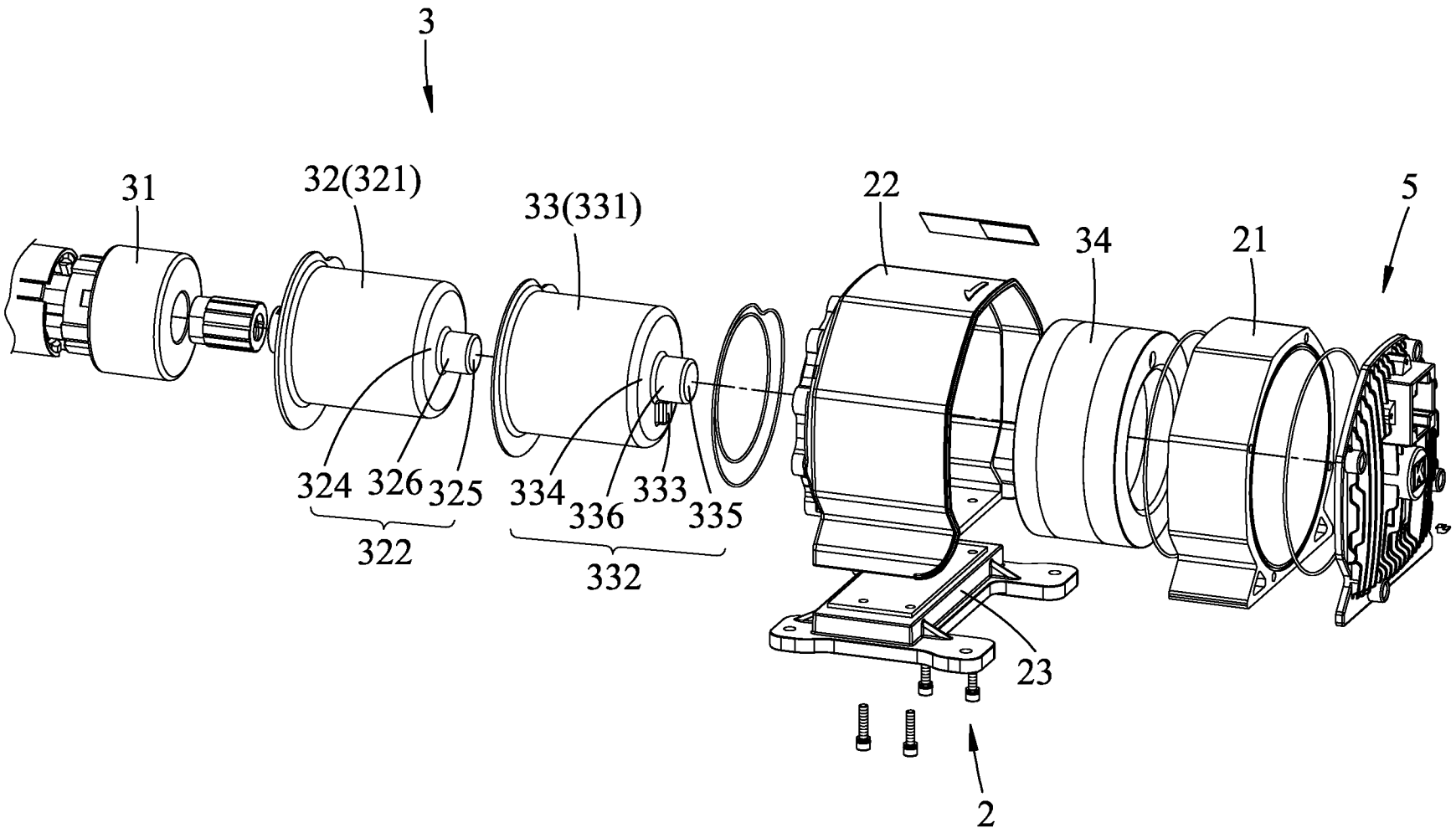
FIG. 2 is a fragmentary, exploded perspective view of the embodiment.
Figure 3:
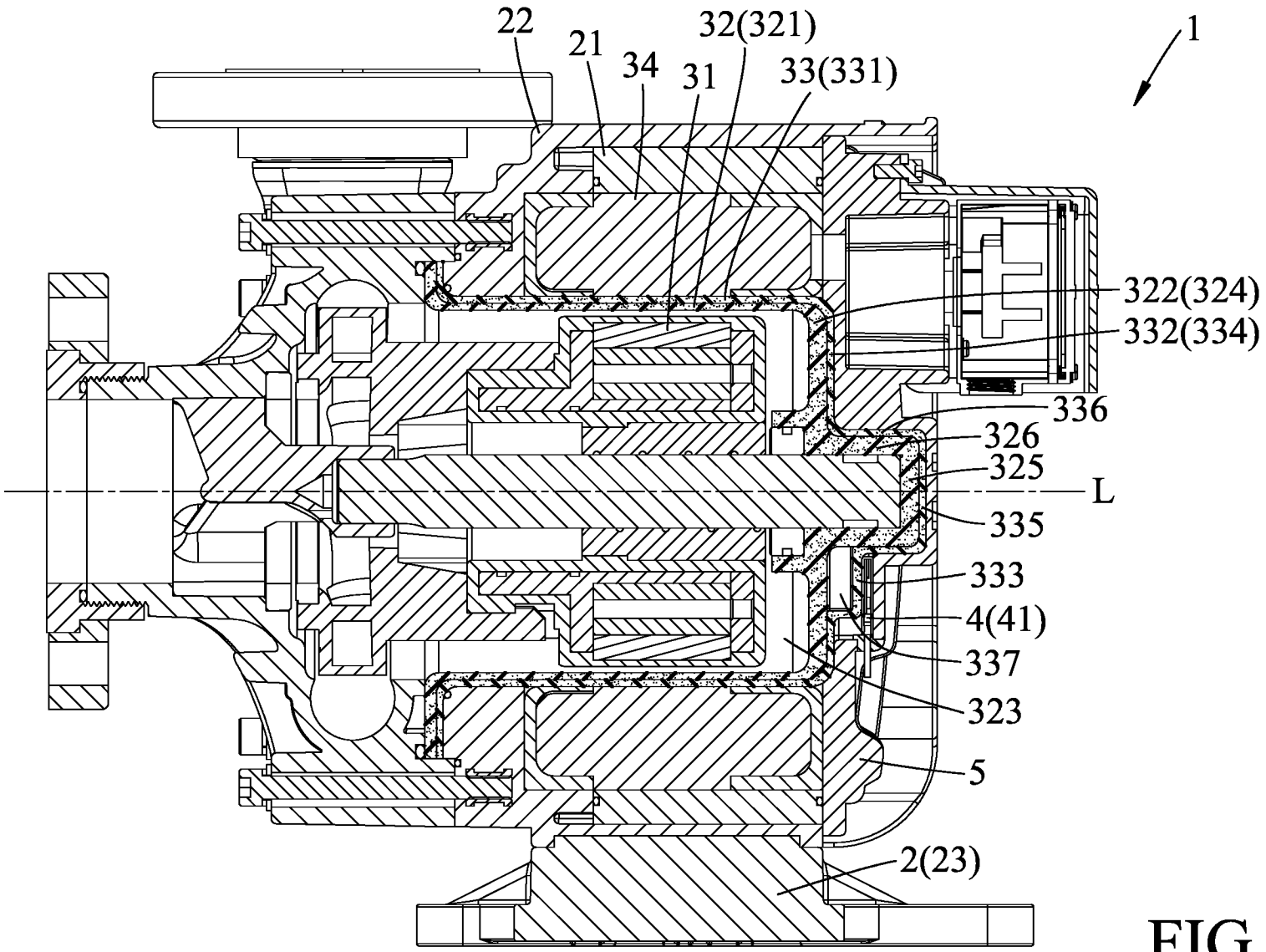
FIG. 3 is a sectional view of the embodiment.

Referring to FIGS. 1 to 3, an embodiment of a pump 1 according to the disclosure includes a seat unit 2, a motor unit 3, a leak detector 4 and a cover 5.

The seat unit 2 includes a fixed seat 21, a surrounding seat 22 and a seat base 23. The fixed seat 21 surrounds an axis (L). The surrounding seat 22 is sleeved on the fixed seat 21. The seat base 23 is for the surrounding seat 22 to be disposed on.

The motor unit 3 is disposed in the seat unit 2, and includes a rotor 31, an inner case body 32, an outer case body 33 and a stator 34. The rotor 31 rotatable about the axis (L). The inner case body 32 surrounds the rotor 31. The outer case body 33 is sleeved on the inner case body 32. The stator 34 surrounds the outer case body 33 and is surrounded by the fixed seat 21 of the seat unit 2 about the axis (L).

The inner case body 32 of the motor unit 3 has an inner surrounding wall 321 and an inner end wall 322. The inner surrounding wall 321 surrounds the rotor 31 of the motor unit 3 and has two inner opposite ends spaced apart from each other in the direction of the axis (L). The inner end wall 322 is connected to one of the inner opposite ends of the inner surrounding wall 321. The inner surrounding wall 321 and the inner end wall 322 cooperatively define a disposing space 323 that opens at the other one of the inner opposite ends and that is for the rotor 31 to be disposed within. Moreover, the inner end wall 322 has an inner annular section 324, an inner end section 325 and an inner connecting section 326. The inner annular section 324 is annular, is connected to the inner surrounding wall 321 of the inner case body 32 and extends radially and inwardly from the one of the inner opposite ends of the inner surrounding wall 321 toward the axis (L). The inner end section 325 is spaced apart from the inner annular section 324 in the direction of the axis (L). The inner connecting section 326 surrounds the axis (L) and interconnects an inner edge of the inner annular section 324 that is approximate to the axis (L) and the inner end section 325 in the direction of the axis (L).

The outer case body 33 of the motor unit 3 has an outer surrounding wall 331 and an outer end wall 332. The outer surrounding wall 331 is sleeved on the inner surrounding wall 321 of the inner case body 32, is surrounded by the stator 34 of the motor unit 3 and has two outer opposite ends that are spaced apart from each other in the direction of the axis (L). The outer end wall 332 is connected to one of the outer opposite ends and is located at one side of the inner end wall 322 opposite to the disposing space 323. Furthermore, the outer end wall 332 has an outer annular section 334, an outer end section 335, an outer connecting section 336, and a protruding wall section 333 that is proximate to the seat base 23 of the seat unit 2. The outer annular section 334 is connected to the outer surrounding wall 331. The outer end section 335 is spaced apart from the outer annular section 334 in the direction of the axis (L). The outer connecting section 336 surrounds the axis (L) and interconnects an inner edge of the outer annular section 334 that is approximate to the axis (L) and the outer end section 335 in the direction of the axis (L). The protruding wall section 333 protrudes from the outer annular section 334 and away from the inner end section 324 of the inner end wall 322 of the inner case body 32, and is connected to the outer connecting section 336. In addition, the protruding wall section 333 cooperates with the inner end section 324 and the inner connecting section 326 of the inner end wall 322 to define a liquid-receiving space 337. The liquid-receiving space 337 is located below the axis (L), and the volume thereof ranges from 2 to 5 cubic centimeters.

The leak detector 4 is disposed on one side of the protruding wall section 333 of the outer end wall 332 that is opposite to the liquid-receiving space 337, and includes a sensor 41. The sensor 41 is for detecting the change of the electrostatic capacity between the liquid-receiving space 337 and the sensor 41. In this embodiment, the sensor 41 is a capacitive proximity sensor.

The cover 5 abuts against the outer end wall 332 of the outer case body 33 of the motor unit 3 and is bolted to the fixed seat 21 of the seat unit 2 such that the leak detector 4 is located between the protruding wall section 333 of the outer end wall 332 and the cover 5.

When the motor unit 3 is in operation of a piece of chemical processing equipment, the sensor 41 is able to continuously detect the change of the electrostatic capacity between the liquid-receiving space 337 and the sensor 41. Once the inner case body 32 of the motor unit 3 is damaged, chemical liquid leaks through the crack of the inner case body 32 into the gap between the inner end wall 322 of the inner case body 32 and the outer end wall 332 of the outer case body 33, and then into the liquid-receiving space 337. Because the liquid-receiving space 337 is able to collect the chemical liquid, the stator 34 of the motor unit 3 can be prevented from being immediately exposed to the leaked chemical liquid. Moreover, the presence of the chemical liquid in the liquid-receiving space 337 causes the change of the electrostatic capacity between the liquid-receiving space 337 and the sensor 41, and the change can be detected by the sensor 41. As soon as the sensor 41 detects the change, a control member (not shown) that is electronically connected to the sensor 41 is able to alert a user about the leakage or to cease the operation of the motor unit 3. Thus, the stator 34 is prevented from being corroded by the chemical liquid, and the motor unit 3 does not malfunction.

In summary, by virtue of the liquid-receiving space 337 being defined by the protruding wall section 333, the inner end section 324 and the inner connecting section 326 of the motor unit 3 and being able to collect leaked chemical liquid between the inner case body 32 and the outer case body 33 of the motor unit 3, and by virtue of the sensor 41 being able to detect the change of the electrostatic capacity between the liquid-receiving space 337 and the sensor 41, the pump 1 can be prevented from malfunctioning. Therefore, the purpose of the disclosure is certainly fulfilled.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pump comprising:

a seat unit including a fixed seat that surrounds an axis, a surrounding seat that is sleeved on said fixed seat, and a seat base that is for said surrounding seat to be disposed on;

a motor unit including a rotor that is rotatable about the axis, an inner case body that surrounds said rotor, an outer case body that is sleeved on said inner case body, and a stator that surrounds said outer case body and that is surrounded by said fixed seat about the axis, said inner case body having an inner surrounding wall that surrounds said rotor and that has two inner opposite ends spaced apart from each other in the direction of the axis, and an inner end wall that is connected to one of said inner opposite ends, said inner surrounding wall and said inner end wall cooperatively defining a disposing space that opens at the other one of said inner opposite ends and that is for said rotor to be disposed within, said outer case body having an outer surrounding wall that is sleeved on said inner surrounding wall, that is surrounded by said stator and that has two outer opposite ends which are spaced apart from each other in the direction of the axis, and an outer end wall that is connected to one of said outer opposite ends and that is located at one side of said inner end wall opposite to said disposing space, said outer end wall cooperating with said inner end wall to define a liquid-receiving space therebetween; and a leak detector disposed on one side of said outer end wall that is opposite to said liquid-receiving space, and including a sensor that is for detecting the change of the electrostatic capacity between said liquid-receiving space and said sensor, wherein said inner end wall of said inner case body of said motor unit has an inner annular section connected to said inner surrounding wall, an inner end section spaced apart from said inner annular section in the direction of the axis, and an inner connecting section surrounding the axis and interconnecting an inner edge of said inner annular section that is approximate to the axis and said inner end section in the direction of the axis;

wherein said outer end wall of said outer case body of said motor unit has an outer annular section connected to said outer surrounding wall, an outer end section spaced apart from said outer annular section in the direction of the axis, and an outer connecting section surrounding the axis and interconnecting an inner edge of said outer annular section that is approximate to the axis and said outer end section in the direction of the axis;

wherein said outer end wall of said outer case body of said motor unit further has a protruding wall section protruding from said outer annular section of said outer end wall and away from said inner end section of said inner end wall and being connected to said outer connecting section of said outer end wall;

wherein said protruding wall section cooperates with said inner end section and said inner connecting section of said inner end wall to define said liquid-receiving space; and wherein said leak detector is disposed on one side of said protruding wall section opposite to said liquid-receiving space.

2. The pump as claimed in claim 1, wherein:

said protruding wall section of said outer end wall of said outer case body is proximate to said seat base of said seat unit; and said liquid-receiving space is located below the axis.

3. The pump as claimed in claim 2, further comprising a cover that abuts against said outer end wall of said outer case body of said motor unit and that is bolted to said fixed seat of said seat unit, said leak detector being located between said protruding wall section of said outer end wall and said cover.

4. The pump as claimed in claim 3, wherein the volume of said liquid-receiving space ranges from 2 to 5 cubic centimeters.

5. The pump as claimed in claim 1, wherein the volume of said liquid-receiving space ranges from 2 to 5 cubic centimeters.

* * * * *